US007468106B2

(12) United States Patent
McLaughlin

(10) Patent No.: US 7,468,106 B2
(45) Date of Patent: Dec. 23, 2008

(54) REMOVAL OF NIOBIUM SECOND PHASE PARTICLE DEPOSITS FROM PICKLED ZIRCONIUM-NIOBIUM ALLOYS

(75) Inventor: David F. McLaughlin, Oakmont, PA (US)

(73) Assignee: Westinghouse Electric Co LLC, Pittsburgh, PA (US)

( * ) Notice: Subject to any disclaimer, the term of this patent is extended or adjusted under 35 U.S.C. 154(b) by 160 days.

(21) Appl. No.: 11/682,981

(22) Filed: Mar. 7, 2007

(65) Prior Publication Data

US 2008/0101527 A1 May 1, 2008

Related U.S. Application Data

(60) Provisional application No. 60/855,472, filed on Oct. 31, 2006.

(51) Int. Cl.
*C23G 1/00* (2006.01)

(52) U.S. Cl. ..... 134/2; 134/3; 134/26; 134/28; 134/34; 134/35; 134/36; 134/40; 134/41; 134/42; 75/715; 148/254; 510/488

(58) Field of Classification Search ..... 134/2, 134/3, 26, 28, 34, 35, 36, 40, 41, 42; 510/488; 75/715; 148/254
See application file for complete search history.

(56) References Cited

U.S. PATENT DOCUMENTS

2008/0101527 A1 * 5/2008 McLaughlin ..... 376/310
2008/0230090 A1 * 9/2008 McLaughlin et al. ..... 134/2

OTHER PUBLICATIONS

Blumenthal, Warren B., "The Chemical Behavior of Zirconium", 1958, pp. 191-193, D. van Nostrand Company, Inc., Princeton, New Jersey, USA.

* cited by examiner

*Primary Examiner*—Sharidan Carrillo

(57) ABSTRACT

The present invention provides a method for removing niobium-rich second-phase-particle (SPP) deposits from zirconium-niobium alloy components. The method comprises washing a freshly pickled and rinsed zirconium-niobium alloy component with an acidified oxalic acid or ammonium oxalate washing solution. The method of the present invention results in a rapid, efficient and complete removal of surface SPP deposits from the zirconium-niobium alloy component without pitting, leaving behind a clean, shiny surface without the need to use water blasting or mechanical wiping operations.

9 Claims, No Drawings

REMOVAL OF NIOBIUM SECOND PHASE PARTICLE DEPOSITS FROM PICKLED ZIRCONIUM-NIOBIUM ALLOYS

This application claims priority under 35 U.S.C. §119(e) to U.S. Provisional Patent Application Ser. No. 60/855,472 filed Oct. 31, 2006, which is incorporated herein by reference.

BACKGROUND OF THE INVENTION

1. Field of the Invention

The present invention is directed to a process for cleaning zirconium-niobium alloys which are used for cladding of fuel in thermal reactors. More particularly, the present invention is directed to a rapid, efficient and complete chemical process for removal of surface second-phase particle deposits from zirconium-niobium alloys, in which a clean, shiny, non-pitted surface is obtained without the need to use water blasting or mechanical wiping operations.

2. Description of the Prior Art

Zirconium (Zr) has many useful properties, among them good physical strength and high corrosion resistance. In its hafnium-purified form, zirconium is widely used as the structural material for nuclear fuel cores, taking advantage of its low neutron absorption cross section. Current alloys used in nuclear grade zirconium applications typically contain tin, iron and sometimes nickel; more recent alloy compositions such as the "Zirlo" alloy (Westinghouse Electric Co., LLC, Pittsburgh, Pa.) also contain percent quantities of niobium (Nb) for improved corrosion resistance in nuclear reactor environments.

Like most metal product applications, fabrication of nuclear reactor fuel tubes and core components leaves the metal with undesirable surface features such as scratches, oxidation stains and chemical contamination from lubricants. Zirconium components therefore are pickled before use and the parts making up the fuel assemblies may be pickled numerous times during the manufacturing process to control the surface quality and remove contaminants. A typical pickling bath for zirconium contains between 10 to 40% weight nitric acid and 1 to 5% hydrofluoric acid, which is a very aggressive solution.

A specific problem arises when pickling niobium-containing zirconium alloys. The niobium tends to segregate within the alloy into very small particles, referred to as second-phase particles (SPPs). The SPPs typically have binary Zr—Nb or ternary Zr—Nb—Fe compositions. When the alloy is pickled, dissolution of the Zr matrix proceeds faster than that of the SPPs, so that large quantities of extremely fine, black particles are released into the pickle acid during the pickling process. Unfortunately, when the zirconium alloy is removed from the pickle acid, even after thorough rinsing, the surface typically is matte black due to a dense coating of adherent particles that do not release from the metal surface during rinsing. This material is known in the industry as "smut," a reference to the similarity of its appearance to black masses of fine fungal spores by the same name.

Before any niobium-zirconium alloy can be used in a nuclear reactor application, all of the "smut" deposit must be removed, partially to yield bright, shiny product surfaces, and to prevent later possible release of such particles into the reactor cooling water and potential deposition within the reactor. On easily accessible exterior surfaces, removal of SPP deposits is not difficult and can be accomplished by water blasting or mechanical wiping with cloths or sponges. However, many final reactor components contain internal surfaces that are not easily accessible, such as the interior of fuel tubes for both pressurized water reactors (PWRs) and boiling water reactors (BWRs), and the interior of channel boxes in BWRs. Mechanical cleaning of some interior surfaces such as smooth cylindrical tubes may be accomplished by dragging cleaning swabs ("pigs") through the component, but other small channels cannot be cleaned effectively, and small crevices cannot be accessed at all.

An ideal solution to the problem would be a chemical wash, in which the component can be dipped, which would either dissolve the SPP deposit or release it from the metal surface. Dissolution of Zr—Nb and Zr—Nb—Fe second phase particles is probably not a likely solution, as any solvent capable of such attack would surely attack the zirconium background even more aggressively, leading to both surface damage and release of still more SPPs from the alloy.

There exists a need, therefore, for a process to quickly and completely remove Zr—Nb and Zr—Nb—Fe second phase particles from the entire surface of zirconium-niobium alloys without damaging the surface of the alloys.

SUMMARY OF THE INVENTION

The present invention fulfills this need by providing a method for removing niobium-rich second-phase-particle (SPP) deposits from the surface of a freshly pickled and rinsed zirconium-niobium alloy component, comprising washing the freshly pickled and rinsed zirconium-niobium alloy component with an acidified oxalic acid or ammonium oxalate washing solution.

It is an object of the present invention to provide a method by which SPP deposits are removed entirely by chemical action, requiring no mechanical wiping or water blasting, and therefore is adaptable for removing SPP deposits from complex interior surfaces inaccessible to wiping and water blasting procedures.

It is a further object of the present invention to provide a method in which the SPP deposits can readily be removed, even after the zirconium-niobium component has been pickled and rinsed in water to remove fluoride and to halt the pickling action, taking advantage of the solubilizing capacity of oxalate towards hydrous zirconium by mixing the oxalate with a second mineral acid.

It is a further object of the present invention to provide a method which can be carried out rapidly without increasing the temperature above ambient temperature, and therefore eliminating the risk of surface damage to the zirconium-niobium alloy component.

It is a further object of the present invention to provide a method which produces a metal surface indistinguishable from that produced by current commercial pickling of zirconium-niobium alloys, which typically is followed by either water blasting or mechanical wiping operations.

It is further object of the present invention to provide a method from which the waste solutions can be treated in an identical manner to current waste pickle acid and pickling rinse solutions, in which calcium hydroxide treatment is used to precipitate calcium oxalate instead of precipitating calcium fluoride.

These and other objects of the present invention will become more readily apparent from the following detailed description and appended claims.

DESCRIPTION OF THE PREFERRED EMBODIMENTS

The present invention provides a method for removing niobium-rich second-phase-particle (SPP) deposits, i.e., SPPs, from the surface of a freshly pickled and rinsed zirconium-niobium alloy component, comprising washing the freshly pickled and rinsed zirconium-niobium alloy component with an acidified oxalic acid or ammonium oxalate washing solution.

In an embodiment, the oxalic acid or ammonium oxalate is acidified with nitric acid. The concentration of the oxalic acid or ammonium oxalate in the washing solution can range between about 1.0 to 8.0 weight %, preferably between about 2.5 to 5.0 weight %, and most preferably is about 2.5 weight %. The concentration of the nitric acid in the washing solution can range between about 1.0 to 40 weight %, preferably between about 5 to 10 weight %, and most preferably is about 5 weight %.

The freshly pickled and rinsed zirconium-niobium alloy component is washed in the washing solution of the present invention for about 1 to 10 minutes, preferably about 2 to 5 minutes or 4 minutes, at ambient room temperature, (i.e., 26° C.). Higher temperatures, such as between 35° C. and 50° C., accelerate the washing process, but increase the likelihood of surface pitting of the zirconium-niobium alloy component and are not recommended.

The method for removing SPP deposits from the surface of a freshly pickled and rinsed zirconium-niobium alloy component can be incorporated easily into current industrial operations from an environmental perspective. In particular, waste pickle acid and/or contaminated pickling rinse solutions typically are treated with calcium hydroxide to neutralize acidity and to immobilize toxic fluoride as $CaF_2$, which has very low solubility. Calcium oxalate also exhibits very low solubility, and thus is readily separable as a solid filter cake from waste solutions resulting from the washing process of the present invention. Hence, the same environmental treatment processes currently used for zirconium alloy pickling can readily be adapted to handle the oxalate washing solutions of the present invention.

As used herein, the term "smut" refers to a dense coating of adherent matte black particles that do not release from the metal surface of a zirconium-niobium alloy during rinsing. The term "smut" and second-phase particle (SPP) deposits are used interchangeably herein.

As used herein, the phrase "Zirlo coupon" refers to a postage-stamp-sized sample of sheet metal alloy composition (Westinghouse Electric Co., LLC, Pittsburgh, Pa.) used for test studies, in which the composition contains tin, iron, and approximately one percent niobium.

The present invention is more particularly described in the following non-limiting example, which is intended to be illustrative only, as numerous modifications and variations therein will be apparent to those skilled in the art.

EXAMPLE 1

Introduction

In order to develop a washing solution capable of releasing SPP deposits from a zirconium-niobium alloy component without dissolving the SPP deposits (and thus dissolving the zirconium background as well), it was necessary to identify the nature of how SPPs affix to the surface of a zirconium-niobium alloy. To this end, preliminary studies were performed at the Westinghouse Electric Co., LLC Science and Technology Department (Pittsburgh, Pa.). These studies revealed that freshly pickled zirconium metal is coated with a very thin layer of hydrous zirconia ($ZrO_2.x\ H_2O$), a result of electrochemical equilibrium between zirconium metal and low pH water. In the specific case where x=2, the hydrous zirconium is stoichiometrically equivalent to zirconium tetrahydroxide: $Zr(OH)_4$. Although $Zr(OH)_4$ actually may not exist, it is convenient to refer to it as such. This layer of zirconium "hydroxide" is very thin, i.e., nanometers in thickness, but is adhesive and behaves as a "glue," which causes comparably small SPPs to adhere to the metal surface of the zirconium-niobium alloy.

Based on these findings, studies were conducted to determine the optimal washing solution capable of removing the zirconium "hydroxide" "glue" from the surface of zirconium-niobium alloys. Zirconium "hydroxide" has an extremely low solubility in water and was known to be soluble only in a few substances, such as very concentrated sodium and/or potassium hydroxide, alkaline hydrogen peroxide, concentrated hydrofluoric and sulfuric acids, oxalic acid and possibly ammonium carbonate (Blumenthal, W. B., *The Chemical Behavior of Zirconium*, D. van Nostrand Co. Inc., Princeton, N.J., 1958, pp. 191-193).

Initial Tests

Seven Zirlo coupons first were subjected to a typical pickling process known in the art. This process included immersing the coupons in a pickling liquid consisting of 40% by weight concentrated nitric acid and 5% by weight concentrated hydrofluoric acid for 20 minutes.

Each Zirlo coupon then was immediately placed in a different washing solution for 4 minutes. The washing solutions included very concentrated sodium and/or potassium hydroxide, alkaline hydrogen peroxide, concentrated hydrofluoric and sulfuric acids, oxalic acid and ammonium carbonate.

The different washing solutions and the ability of these washing solutions to remove SPP deposits from the coupons are shown in Table 1.

TABLE 1

| Efficacy of Different Washing Solutions to Remove "Smut" from Zirlo Coupons | | | | | |
|---|---|---|---|---|---|
| Concentrated sodium hydroxide | Concentrated potassium hydroxide | Alkaline hydrogen peroxide | Concentrated sulfuric acid | Oxalic acid/ammonium oxalate | Ammonium carbonate |
| Not effective; reacted slowly and removed "smut" incompletely. | Not effective; reacted slowly and removed "smut" incompletely. | Incomplete removal of "smut." | Effective; but caused unacceptable surface damage. | Effective quickly with no surface damage. | Not effective. |

Of the washing solutions tested, only oxalate was found to be successful at quickly removing "smut" without damaging the surface of the Zirlo coupons. Thus, these tests demonstrated that freshly pickled Zirlo coupons dipped immediately in either oxalic acid or ammonium oxalate would immediately release surface SPP deposits, leaving a clean and shiny surface to the coupons. The SPP deposits did not appear to dissolve in the washing solution but rather accumulated in the bottom of the reaction vessel.

Further Testing

Commercial pickling operations always are followed immediately by thorough rinsing, preferably in deionized water, to halt the pickling reaction and to maintain a good surface finish.

In one set of experiments, it was found that if the freshly pickled Zirlo coupons first were rinsed in deionized water, neither oxalic acid nor ammonium oxalate removed the "smut." Apparently, exposure to water had the effect of "fixing" the $ZrO_2.x\ H_2O$ layer and rendering it insoluble (or of a much lower solubility) in the oxalate solution.

In another set of experiments, it was found that if the freshly pickled Zirlo coupons first were rinsed in oxalate in place of deionized water, there was a gradual buildup of fluoride contamination in the oxalate bath, which would gradually also act to "fix" surface SPP deposits, so that the effectiveness of the bath diminished over time.

In a final set of tests, it was discovered that the key to successful use of oxalate to remove SPP deposits from pickled, rinsed zirconium alloy was to acidify the oxalate with another mineral acid. Nitric acid was selected because of its known property of not interacting with zirconium directly, which interaction could cause damage the surface of the alloy.

In particular, a solution of 2.5 to 5% by weight oxalic acid plus 5% by weight nitric acid was used as a washing solution, at ambient temperatures, i.e., about 26° C., after the Zirlo coupons were pickled, as described above, and after thorough rinsing in deionized water for 20 minutes. This resulted in a rapid and efficient removal of surface SPP deposits from the coupons.

The above-described method had the advantage that essentially no SPP deposits accumulated in the oxalate solution. Rather, SPP deposits were found to be released only after the coupons were removed form the oxalate-nitric acid wash solution and placed into a second rinse bath.

Additionally, this method was found to be effective over a wide range of oxalic acid concentrations, i.e., from 1% to 8% by weight. In addition, a broad range of nitric acid concentrations, i.e., 5 to 40% by weight, also were effective. Higher concentrations of nitric acid above about 40% by weight were found to cause pitting of the metal surface of the coupons.

Finally, raising the temperature of the oxalate-nitric acid wash solution, i.e., to between about 35° C. to 50° C., reduced the time required to remove the "smut" deposit. However, this also resulted in damage to the metal surface of the coupons in the form of many small pits.

CONCLUSION

Subjecting Zirlo coupons to a typical pickling process known in the art, a thorough rinsing step in deionized water and then a washing step using a wash solution of 5% by weight oxalic acid and 5% by weight nitric acid at ambient temperatures, i.e., about 26° C., resulted in a rapid and efficient removal of surface SPP deposits from the coupons without pitting, leaving behind a clean, shiny surface.

While specific embodiments have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the method described herein, which is to be given the full breadth of the appended claims and any and all equivalents thereof.

What is claimed is:

1. A method for removing niobium-rich second-phase-particle (SPP) deposits from a surface of a freshly pickled and rinsed zirconium-niobium alloy component, comprising washing the freshly pickled and rinsed zirconium-niobium alloy component with an acidified oxalic acid or an acidified ammonium oxalate washing solution to remove said niobium-rich second-phase-particle (SPP) deposits from the surface of said zirconium-niobium alloy component.

2. The method of claim 1, wherein oxalic acid or ammonium oxalate is acidified with nitric acid.

3. The method of claim 1, wherein the zirconium-niobium alloy component is washed in the washing solution for about 1 to 10 minutes.

4. The method of claim 1, wherein the zirconium-niobium alloy component is washed in the washing solution for about 2 to 5 minutes.

5. The method of claim 1, wherein the zirconium-niobium alloy component is washed in the washing solution having a temperature of about 26° C. for about 4 minutes.

6. The method of claim 1, wherein waste solution of the washing solution is treated with calcium hydroxide to precipitate calcium oxalate.

7. The method of claim 2, wherein a concentration of oxalic acid or ammonium oxalate in the washing solution ranges from between about 1.0 to 8.0 weight percent and the concentration of nitric acid in the washing solution ranges from between about 1.0 to 40.0 weight percent.

8. The method of claim 2, wherein a concentration of oxalic acid or ammonium oxalate in the washing solution ranges from between about 2.5 to 5.0 weight percent and the concentration of nitric acid in the washing solution ranges from between about 5.0 to 10.0 weight percent.

9. The method of claim 2, wherein a concentration of oxalic acid or ammonium oxalate in the washing solution is about 2.5 weight percent and a concentration of nitric acid in the washing solution is about 5 weight percent.

* * * * *